US010723582B2

(12) United States Patent
Schoulz

(10) Patent No.: US 10,723,582 B2
(45) Date of Patent: Jul. 28, 2020

(54) METHOD AND APPARATUS FOR FOLDING A PRODUCT

(71) Applicant: Kimberly-Clark Worldwide, Inc., Neenah, WI (US)

(72) Inventor: Adam Nicholas Schoulz, Mason, OH (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 27 days.

(21) Appl. No.: 14/911,607

(22) PCT Filed: Jul. 23, 2014

(86) PCT No.: PCT/US2014/047871
§ 371 (c)(1),
(2) Date: Feb. 11, 2016

(87) PCT Pub. No.: WO2016/014054
PCT Pub. Date: Jan. 28, 2016

(65) Prior Publication Data

US 2016/0194174 A1 Jul. 7, 2016

(51) Int. Cl.
*B65H 45/18* (2006.01)
*B65H 45/16* (2006.01)
*B65H 45/10* (2006.01)

(52) U.S. Cl.
CPC ..... *B65H 45/18* (2013.01); *B65H 45/10* (2013.01); *B65H 45/16* (2013.01); *B65H 2301/44734* (2013.01); *B65H 2301/44735* (2013.01); *B65H 2406/33* (2013.01); *B65H 2701/174* (2013.01); *B65H 2701/1924* (2013.01)

(58) Field of Classification Search
CPC ..... B65H 45/18; B65H 45/10; B65H 45/16; B65H 2301/44735; B65H 2301/44734; B65H 2406/33; B65H 2701/174; B65H 2701/1924
USPC ..... 493/418, 434
See application file for complete search history.

(56) References Cited

U.S. PATENT DOCUMENTS

| | | | | |
|---|---|---|---|---|
| 3,142,428 | A | 7/1964 | Faeber | |
| 4,693,784 | A | 9/1987 | Aula et al. | |
| 4,706,863 | A | 11/1987 | Hirakawa et al. | |
| 5,842,964 | A * | 12/1998 | Huber | B65H 45/16 493/417 |
| 6,488,194 | B1 | 12/2002 | Couturier | |

(Continued)

FOREIGN PATENT DOCUMENTS

| | | |
|---|---|---|
| DE | 92 05 154 U1 | 6/1992 |
| EP | 0 233 377 A1 | 8/1987 |

(Continued)

*Primary Examiner* — Sameh Tawfik
(74) *Attorney, Agent, or Firm* — Kimberly-Clark Worldwide, Inc.

(57) ABSTRACT

A method and apparatus include directing an article to a receiving device; transferring the leading portion of the article to a folding device; transferring the leading portion of the article to an oscillating device while holding the trailing portion of the article on the receiving device; reversing the oscillating device; folding the article by overlaying the leading portion of the article on the trailing portion of the article to define a folded state while continuing to hold the trailing portion of the article on the receiving device.

13 Claims, 11 Drawing Sheets

(56) References Cited

U.S. PATENT DOCUMENTS

| | | | | |
|---|---|---|---|---|
| 7,303,522 | B2 * | 12/2007 | Watanabe | B65H 45/168 493/424 |
| 7,399,266 | B2 | 7/2008 | Aiolfi et al. | |
| 8,079,995 | B2 | 12/2011 | Tachauer et al. | |
| 8,939,445 | B2 | 1/2015 | Schoultz et al. | |
| 2002/0140151 | A1 | 10/2002 | Couturier | |
| 2003/0119404 | A1 | 6/2003 | Belau et al. | |
| 2003/0134559 | A1 | 7/2003 | Delzer et al. | |
| 2004/0267220 | A1 | 12/2004 | Hull et al. | |
| 2005/0256477 | A1 | 11/2005 | Van Gompel et al. | |
| 2006/0154795 | A1 * | 7/2006 | Ochsenbauer | B31F 1/0019 493/427 |
| 2007/0176039 | A1 | 8/2007 | Gelli et al. | |
| 2011/0003673 | A1 | 1/2011 | Piantoni et al. | |
| 2012/0152695 | A1 | 6/2012 | Coenen et al. | |
| 2012/0157284 | A1 * | 6/2012 | Coenen | B65H 45/16 493/405 |
| 2012/0157286 | A1 | 6/2012 | Coenen et al. | |
| 2012/0157288 | A1 | 6/2012 | Coenen et al. | |
| 2014/0000782 | A1 * | 1/2014 | Heinrich | B65H 29/243 156/60 |

FOREIGN PATENT DOCUMENTS

| | | | |
|---|---|---|---|
| EP | 0 385 818 | B1 | 4/1994 |
| JP | 2003-063508 | A | 3/2003 |
| WO | WO 1990/002840 | A1 | 3/1990 |
| WO | WO 1990/002841 | A1 | 3/1990 |
| WO | WO 2003/041626 | A1 | 5/2003 |

* cited by examiner

METHOD AND APPARATUS FOR FOLDING A PRODUCT

BACKGROUND OF THE INVENTION

The field of the present invention relates generally to apparatus using vacuum rolls and conveying means for holding, controlling, transferring, folding, winding or otherwise handling flexible materials and products.

One known type of vacuum roll includes a rotatable outer cylindrical wall defining an interior space and a plurality of apertures extending through the cylindrical wall and in fluid communication with the interior space. One or more stationary vacuum manifolds are disposed within the interior space and operatively connected to a vacuum source. Vacuum can be selectively applied to one or more of the vacuum manifolds by operating the vacuum source.

In another known type of vacuum roll, each of the vacuum manifolds is rotatable with the outer cylindrical wall. For example, a first plurality of apertures in the cylindrical wall is in fluid communication with one of the manifolds and a second plurality of apertures in the cylindrical wall is in fluid communication with another one of the manifolds. Vacuum can be selectively applied to the first plurality of apertures and/or the second plurality of apertures at any location about the rotation of the outer cylinder by regulating the vacuum applied by the vacuum source to the respective manifold. Regulation of the vacuum source is most commonly performed using one or more valves (e.g., solenoid valves). In other words, the vacuum applied to each of the manifolds can be selectively turned "on" and "off" by opening and closing a valve.

However, there remains a need for a folding apparatus capable of handling materials or products at high line speeds using vacuum rolls and conveying means with stationary vacuum manifolds and constant vacuum profiles.

SUMMARY OF THE INVENTION

In one aspect, the present invention provides a method for folding an article. The method includes directing the article to a receiving device moving in a first direction. The article defines a leading portion and a trailing portion. The method further includes holding the leading portion of the article on the receiving device. The method also includes transferring the leading portion of the article to a folding device moving in a second direction, opposite the first direction. The method further includes transferring the leading portion of the article from the folding device to an oscillating device moving in the first direction while holding the trailing portion of the article on the receiving device moving in the first direction. The method includes reversing the oscillating device to move in the second direction while continuing to hold the leading portion of the article on the oscillating device and while continuing to hold the trailing portion of the article on the receiving device moving in the first direction. The method includes folding the article by overlaying the leading portion of the article on the trailing portion of the article to define a folded state while continuing to hold the trailing portion of the article on the receiving device moving in the first direction.

In some embodiments of this aspect, the receiving device may be a vacuum conveyor, the folding device may be a vacuum roll, and the oscillating device may be a vacuum roll. In this configuration, the method may further include moving the receiving device continuously in the first direction, rotating the folding device continuously in the second direction, and rotating the oscillating device alternately between the first direction and the second direction.

In another embodiment, the method further includes communicating a first vacuum supply to a fixed internal vacuum sector of the receiving device; communicating a second vacuum supply to a fixed internal vacuum sector of the folding device; and communicating a third vacuum supply to a fixed internal vacuum sector of the oscillating device.

In some embodiments, the receiving device and the folding device define a first nip, the folding device and the oscillating device define a second nip, the oscillating device and the receiving device define a third nip, and the internal vacuum sector of the folding device extends from a position proximate the first nip to a position proximate the second nip relative to the second direction of movement. In these embodiments, the method may further include directing the leading portion of the article through the first nip, directing the leading portion of the article through the second nip after the first nip, directing the leading portion of the article through the third nip after the second nip, directing the leading portion of the article through the fourth nip after the third nip, directing the trailing portion of the article through the first nip, bypassing the second nip with the trailing portion of the article after the first nip, and directing the trailing portion of the article through the third nip after bypassing the second nip.

In some embodiments, the method further includes providing the first vacuum supply, the second vacuum supply, and the third vacuum supply continuously.

In some embodiments, the receiving device and a transfer device define a fourth nip and the method further includes communicating a fourth vacuum supply to a fixed internal vacuum sector of the transfer device and transferring the article in the folded state from the receiving device to the transfer device moving in the second direction.

In some embodiments, the method further includes first, moving the leading portion of the article at a first speed; second, moving the trailing portion of the article at the first speed; third, moving the leading portion of the article at a second speed, slower than the first speed, while continuing to move the trailing portion of the article at the first speed; fourth, stopping the leading portion of the article while continuing to move the trailing portion of the article at the first speed; fifth, accelerating the leading portion of the article to the first speed; and sixth, moving the leading portion and the trailing portion at the first speed. In some embodiments, the third step may include moving the leading portion in a first direction and the fifth step may include moving the leading portion in a second direction that is different than the first direction.

In another aspect, the present invention provides a method for folding an article. The method includes directing the article to a receiving roll rotating in a first direction. The article defining a leading portion and a trailing portion. The method further includes moving the leading portion of the article at a first speed and moving the trailing portion of the article at the first speed; holding the leading portion of the article on the receiving roll; transferring the leading portion of the article to a folding roll rotating in a second direction, opposite the first direction; transferring the leading portion of the article from the folding roll to an oscillating roll rotating in the first direction while holding the trailing portion of the article on the receiving roll rotating in the first direction; moving the leading portion of the article at a second speed, slower than the first speed, while continuing to move the trailing portion of the article at the first speed; stopping the leading portion of the article while continuing to move the trailing portion of the article at the first speed; reversing the oscillating roll to rotate in the second direction while continuing to hold the trailing portion of the article on the receiving roll rotating in the first direction; accelerating the leading portion of the article to the first speed; folding the article by overlaying the leading portion of the article on the trailing portion of the article to define a folded state while continuing to hold the trailing portion of the article on the receiving roll rotating in the first direction; and moving the leading portion and the trailing portion at the first speed in the folded state.

In some embodiments of this aspect, the leading portion of the article may be transferred incrementally from the receiving roll to the folding roll and from the folding roll to the oscillating roll. In some embodiments, the leading portion of the article may be folded incrementally when transitioned from the oscillating roll to the receiving roll. In some embodiments, the leading portion of the article may be folded and in facing relation to and aligned with the trailing portion of the article.

In various embodiments, the method further includes providing a continuous vacuum supply to a fixed internal vacuum sector of the receiving roll; providing a continuous vacuum supply to a fixed internal vacuum sector of the folding roll; providing a continuous vacuum supply to a fixed internal vacuum sector of the oscillating roll; and providing a continuous vacuum supply to a fixed internal vacuum sector of the transferring roll.

In another aspect, the present invention provides an apparatus for folding an article. The apparatus includes a receiving device having an outer surface defined by an open area and a closed area. The receiving device having a fixed internal vacuum sector and a fixed internal non-vacuum sector. The receiving device being adapted to communicate vacuum force through the open area when the open area is aligned with the fixed internal vacuum sector. The apparatus also includes a folding device having an outer surface defined by an open area and a closed area. The folding device having a fixed internal vacuum sector and a fixed internal non-vacuum sector. The folding device being adapted to communicate vacuum force through the open area when the open area is aligned with the fixed internal vacuum sector. The apparatus also includes an oscillating device having an outer surface defined by an open area and a closed area. The outer surface of the oscillating device being adapted to oscillate in opposing directions. The oscillating device having a fixed internal vacuum sector and a fixed internal non-vacuum sector. The oscillating device being adapted to communicate vacuum force through the open area when the open area is aligned with the fixed internal vacuum sector. The apparatus also includes a transfer device having an outer surface defined by an open area and a closed area. The transfer device having a fixed internal vacuum sector and a fixed internal non-vacuum sector. The transfer device being adapted to communicate vacuum force through the open area when the open area is aligned with the fixed internal vacuum sector. The apparatus also including a first nip defined between the receiving device and the folding device; a second nip defined between the folding device and the oscillating device; a third nip defined between the oscillating device and the receiving device; and a fourth nip defined between the receiving device and the transfer device. The apparatus also includes a product path having a first part defining a path traveled by the leading portion of the article through the apparatus and a second part defining a path traveled by the trailing portion of the article through the apparatus. The first part includes, in order of travel, the internal vacuum sector of the receiving device; the first nip; the internal vacuum sector of the folding device; the second nip; the internal vacuum sector of the oscillating device; the third nip; the internal vacuum sector of the receiving device; the fourth nip; and the internal vacuum sector of the transfer device. The second part includes, in order of travel, the internal vacuum sector of the receiving device; the first nip; the third nip; the fourth nip; and the internal vacuum sector of the transfer device.

In some embodiments, the outer surface of the receiving device is adapted to move continuously in a first direction, the outer surface of the folding device is adapted to move continuously in a second direction, opposite the first direction; the outer surface of the oscillating device is adapted to move alternately between the first direction and the second direction; and the outer surface of the transfer device is adapted to move in the second direction.

In some embodiments, the receiving device is adapted to continuously receive vacuum force in an internal vacuum sector of the receiving device and continuously provide vacuum force to the open area of the outer surface when aligned with the internal vacuum sector of the receiving device. The folding device is adapted to continuously receive vacuum force in an internal vacuum sector of the folding device and continuously provide vacuum force to the open area of the outer surface when aligned with the internal vacuum sector of the folding device. The oscillating device is adapted to continuously receive vacuum force in an internal vacuum sector of the receiving device and continuously provide vacuum force to the open area of the outer surface when aligned with the internal vacuum sector of the receiving device. The transfer device is adapted to continuously receive vacuum force in an internal vacuum sector of the transfer device and continuously provide vacuum force to the open area of the outer surface when aligned with the internal vacuum sector of the receiving device.

In some embodiments, the internal vacuum sector of the receiving device extends from a position proximate a product entry point to proximate the fourth nip relative to the first direction of movement; the internal vacuum sector of the folding device extends from a position proximate the first nip to a position proximate the second nip relative to the second direction of movement; the internal vacuum sector of the oscillating device extends from a position proximate the third nip to a position distal the third nip relative to the first direction of movement; and the internal vacuum sector of the transfer device extends from a position proximate the fourth nip to a position proximate a product transferring nip.

In some embodiments, the receiving device, the folding device, the oscillating device, and the transfer device are vacuum rolls. In some embodiments, the receiving device and the transfer device are vacuum conveyors and the folding device and the oscillating device are vacuum rolls.

DETAILED DESCRIPTION OF THE DRAWINGS

Figure 1:
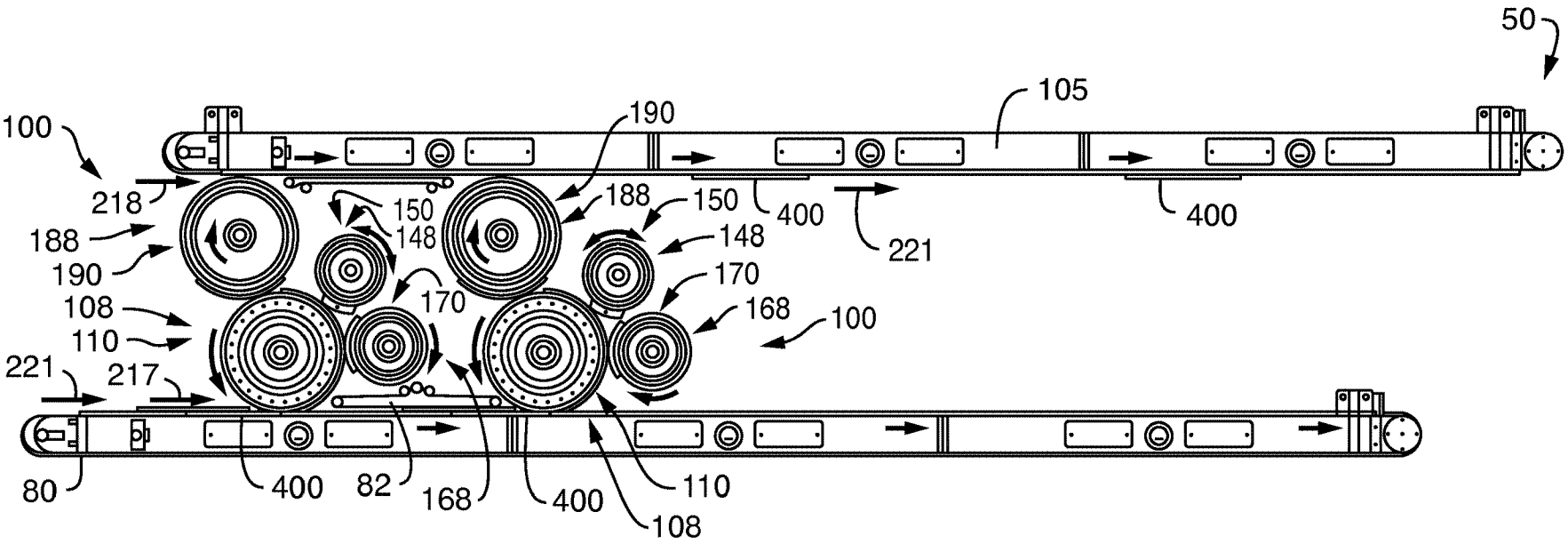
FIG. 1 is a schematic view of a portion of an exemplary product manufacturing system having a first folding apparatus and a second folding apparatus.

FIG. 1 is a schematic view of a portion of an exemplary manufacturing system, indicated generally at 50, for manufacturing products (such as personal care products) having two folding apparatuses, indicated generally at 100. The illustrated configuration of the manufacturing system 50 has two folding apparatuses 100 but it is contemplated that the system could have one, three, four or more folding apparatuses. The folding apparatuses 100 are capable of maintaining accurate control of the product while it is being folded at high line speeds. As a result, the products being manufactured by the illustrated system 50 are folded more precisely, with greater repeatability, and with less force (and thus less product damage and deformation) than prior art folding apparatus, such as blade folding apparatus. As used herein, the term "high line speed" refers to product manufacturing rates of 400 products per minute (ppm) or greater, such as 400 ppm to 4000 ppm, or 600 ppm to 3000 ppm, or 900 ppm to 1500 ppm. However, it is understood that the product manufacturing rate is directly dependent on the product being manufactured. Thus, the term "high line speed" is relative and can differ from one product to another.

For exemplary purposes only, the illustrated manufacturing system 50 and thus, the folding apparatus 100 will be described herein as used with a disposable training pant manufacturing system. It is understood, however, that the manufacturing system 50 and folding apparatus 100 can be configured to manufacture and fold numerous other products, including but not limited to, other types of personal care products, foil products, film products, woven products, packaging products, industrial products, food products, and the like, whether disposable or non-disposable, and whether absorbent or non-absorbent, without departing from the scope of the invention. Other suitable personal care products that could be manufactured by the system 50 and folded by the folding apparatus 100 and using the methods described herein include, but are not limited to, diapers, adult incontinence garments, panty liners, and feminine pads.

As illustrated in FIG. 1, a plurality of discrete training pants 400 are fed along a first conveying member, indicated generally at 80. The first conveying member 80 delivers each of the training pants 400 (generally, "a product") in a pre-folded configuration to one of the two folding apparatus 100 for converting the training pants from a pre-folded configuration to a folded configuration. The folded training pants 400 are conveyed away from the respective folding apparatus 100 by a second conveying member, indicated generally at 105, to other components (not shown) of the manufacturing system 50.

In the embodiment illustrated in FIG. 1, half of the training pants 400 are delivered to each of the folding apparatus 100. Devices suitable for use as the first conveying member 80 are well known in the art and include, but are not limited to, drums, rollers, belt conveyors, air conveyors, vacuum conveyors, chutes, and the like. For exemplary purposes, the first conveying member 80 is illustrated herein as a vacuum belt conveyor. In some embodiments, the first conveying member 80 may include a conveying-assist device 82 to assist in keeping the training pants in a controlled position during advancement as illustrated in FIG. 1. Conveying-assist means are well-known in the art and, for example, include support belts, vacuum means, support rolls, secondary conveyor belts, guide plates, and the like.

Figure 2:
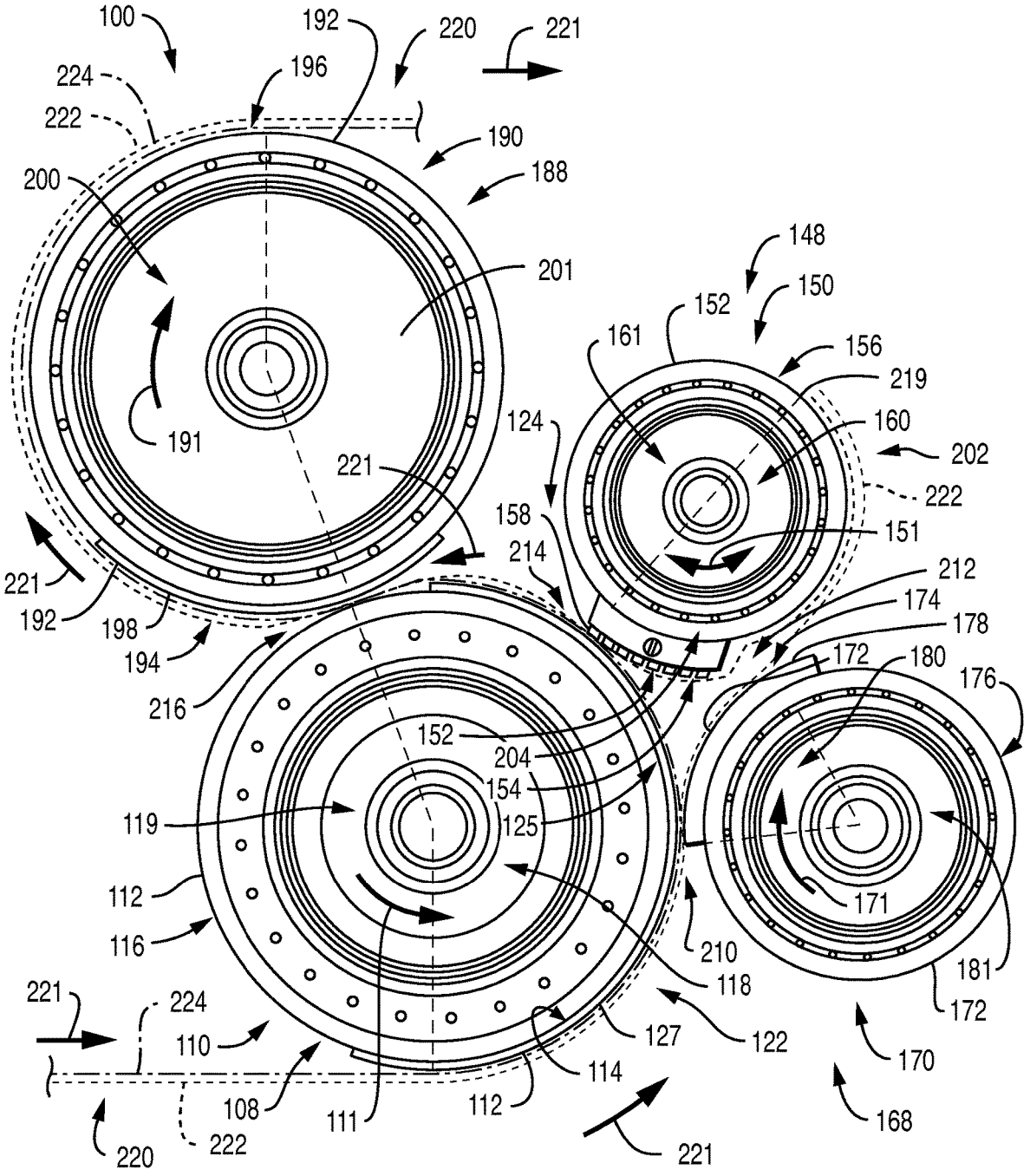
FIG. 2 is a side view of one of the folding apparatus of FIG. 1 removed from the manufacturing system.

Both of the folding apparatus 100 illustrated in FIG. 1 are substantially the same so only one exemplary folding apparatus 100 is illustrated in FIG. 2 and described herein. Referring to FIG. 2, the folding apparatus 100 generally includes a receiving device 108, an oscillating device 148, a folding device 168, and a transfer device 188. Apparatus suitable for use as the receiving device 108, the oscillating device 148, the folding device 168, and/or the transfer device 188 are well known in the art and include, but are not limited to, drums, rolls, belts, and other suitable conveying means. For exemplary purposes, the receiving device 108 is illustrated and described herein as a vacuum roll 110, the oscillating device 148 is illustrated as an oscillating roll 150, the folding device 168 is illustrated as a folding roll 170, and the transfer device 188 is illustrated as a transfer roll 190. It is understood, however, that any or all of the vacuum rolls described and/or illustrated herein may be replaced with any suitable vacuum conveyor(s) or other transfer device having similar functionality and any or all of the vacuum conveyors described and/or illustrated herein may be replaced with any suitable vacuum roll(s) or other transfer device having similar functionality. It is also understood, that any or all references to and illustrations of rolls rotating in a first direction or rotating in a second direction may be replaced with any suitable vacuum conveyor(s) or other transfer device moving in the first direction or moving in the second direction. Suitable receiving rolls, folding rolls, oscillating rolls, and transfer rolls are described in U.S. Patent Application Publication number 2012/0152695, filed Dec. 17, 2010, the entirety of which is incorporated herein by reference where not contradictory.

The folding apparatus 100 includes a first nip 210 defined between the receiving roll 110 and the folding roll 170; a second nip 212 defined between the folding roll 170 and the oscillating roll 150; a third nip 214 defined between the oscillating roll 150 and the receiving roll 110; and a fourth nip 216 defined between the receiving roll 110 and the transfer roll 190. In some embodiments, the folding apparatus 100 also includes a receiving nip 217 (FIG. 1) defined between the receiving roll 110 and the first conveying member 80 and a transfer nip 218 (FIG. 1) defined between the transfer roll 190 and the second conveying member 105.

The receiving device 108 is adapted to move in a direction indicated by the arrow 111. In the illustrated embodiment, the receiving device 108 is illustrated as a receiving roll 110 adapted to rotate in the direction 111. As illustrated, the receiving roll 110 is rotated in a counterclockwise direction (broadly, a first direction). The receiving roll 110 may be driven at any suitable surface speed. In some embodiments, the receiving roll 110 is driven at a constant surface speed, and suitably at the same surface speed that the training pant 400 is traveling on the first conveying member 80. The receiving roll 110 has an outer surface 112 which includes an open area 114 and a closed area 116. The receiving roll 110 may also include an engagement member 127 adapted to receive, hold, and feed the training pant through the folding apparatus 100. The engagement member 127 may include some or all of the open area 114 on the surface of the receiving roll 110. The open area 114 allows communication of vacuum forces from a vacuum source (not illustrated) to an internal vacuum sector 118 and to the outer surface 112 of the receiving roll 110 when the open area 114 is aligned with the internal vacuum sector 118. The receiving roll 110 also includes an internal non-vacuum sector 119 wherein no vacuum forces are communicated to the outer surface of the receiving roll regardless of the position of the open area 114. The vacuum source may provide continuous vacuum force or intermittent vacuum force to the internal vacuum sector 118. The internal vacuum sector 118 and the internal non-vacuum sector 119 are fixed within the receiving roll 110. As used herein, the term "fixed" refers to an internal vacuum sector that makes vacuum force available to a specific portion of a roll (or any other conveying means, e.g., a vacuum conveyor) independent of the external surface movement and does not change over time. The term "fixed" also refers to an internal non-vacuum sector wherein vacuum force is unavailable to a specific portion of a roll (or any other conveying means, e.g., a vacuum conveyor) regardless of any external surface movement and does not change over time. For example, referring to FIG. 2, the fixed internal vacuum sector 118 is illustrated as extending, in the direction of rotation 111, from approximately the 6:00 position to approximately the 11:00 position as described relative to the side view of the receiving roll 110. Likewise, the fixed internal non-vacuum sector 119 is illustrated as extending, in the direction of rotation 111, from approximately the 11:00 position to approximately the 6:00 position as described relative to the side view of receiving roll 110. Therefore, vacuum force is available for communication to the outer surface 112 through the open area 114 of receiving roll 110 when the open area 114 is moved from the 6:00 position to the 11:00 position. Likewise, vacuum force is not available for communication to the outer surface 112 through the open area 114 of the receiving roll 110 when the open area 114 is moved from the 11:00 position to the 6:00 position in the direction of rotation 111. The position of the fixed internal vacuum sector 118 and the fixed internal non-vacuum sector 119 may also be described relative to the various nips in the folding apparatus 100. For example, the fixed internal vacuum sector 118 is illustrated as extending, in the direction of rotation 111, from a position proximate the receiving nip 217 (FIG. 1) to a position proximate the fourth nip 216 as described relative to the side view of receiving roll 110. Likewise, the fixed internal non-vacuum sector 119 is illustrated as extending, in the direction of rotation 111, from a position proximate the fourth nip 216 to a position proximate the receiving nip 217 (FIG. 1) as described relative to the side view of receiving roll 110. The delineation between the internal vacuum sector 118 and the internal non-vacuum sector 119 is illustrated with a dashed line.

In various embodiments, the engagement member 127 can be flush with the remainder of the outer surface 112 or may be raised relative to the remainder of the outer surface 112 as illustrated in FIG. 2. The open area 114 may include a plurality of openings having any suitable arrangement, quantity, shape, size, or profile. In some embodiments, the openings may be circular apertures which may be arranged to generally match the profile of the pre-folded configuration of the training pant. The illustrated receiving roll 110 is adapted to receive and hold one training pant per revolution. However, in various embodiments, the receiving device 108 or the receiving roll 110 may be adapted to receive and hold a plurality of training pants per revolution.

The folding device 168 is adapted to move in a direction indicated by the arrow 171. In the illustrated embodiment, the folding device 168 is illustrated as a folding roll 170 adapted to rotate in the direction 171. As illustrated, the folding roll 170 is rotated in a clockwise direction (broadly, a second direction). The folding roll 170 may be driven at any suitable surface speed. In some embodiments, the folding roll 170 is driven at a constant surface speed, and suitably at the same surface speed as the receiving roll 110. The folding roll 170 has an outer surface 172 which includes an open area 174 and a closed area 176. The folding roll 170 may also include an engagement member 178 adapted to receive, hold, and transfer a portion of the training pant from the receiving roll 110 to the oscillating roll 150. The engagement member 178 may include some or all of the open area 174 on the surface of the folding roll 170. The open area 174 allows communication of vacuum forces from a vacuum source (not illustrated) to an internal vacuum sector 180 and, ultimately, to the outer surface 172 of the folding roll 170 when the open area 174 is aligned with the internal vacuum sector 180. The folding roll 170 also includes a non-vacuum sector 181 wherein no vacuum forces are communicated to the outer surface of the roll regardless of the position of the open area 174. The vacuum source may provide continuous vacuum force or intermittent vacuum force to the fixed internal vacuum sector 180. The internal vacuum sector 180 and the internal non-vacuum sector 181 are fixed within the folding roll 170. In FIG. 2, the fixed internal vacuum sector 180 is illustrated as extending, in the direction of rotation 171, from approximately the 9:00 position to approximately the 11:00 position as described relative to the side view of folding roll 170. Likewise, the fixed internal non-vacuum sector 181 is illustrated as extending, in the direction of rotation 171, from approximately the 11:00 position to approximately the 9:00 position as described relative to the side view of the folding roll 170. Therefore, vacuum force is available for communication to the outer surface 172 through the open area 174 of folding roll 170 when the open area 174 is moved, in the direction of rotation 171, from the 9:00 position to the 11:00 position. Likewise, vacuum force is not available for communication to the outer surface 172 through the open area 174 of the folding roll 170 when the open area 174 is moved, in the direction of rotation 171, from the 11:00 position to the 9:00 position. Said another way, the fixed internal vacuum sector 180 is illustrated as extending, in the direction of rotation 171, from a position proximate the first nip 210 to a position proximate the second nip 212 as described relative to the side view of folding roll 170. Likewise, the fixed internal non-vacuum sector 181 is illustrated as extending, in the direction of rotation 171, from a position proximate the second nip 212 to a position proximate the first nip 210 as described relative to the side view of folding roll 170. The delineation between the internal vacuum sector 180 and the internal non-vacuum sector 181 is illustrated with a dashed line.

In various embodiments, the engagement member 178 may be flush with the remainder of the outer surface 172 of the folding roll 170 or may be raised relative to the remainder of the outer surface 172 as illustrated in FIG. 2. The open area 174 may include a plurality of openings having any suitable arrangement, quantity, shape, size, or profile. In some embodiments, the openings may be circular apertures which may be arranged to generally match the profile of the training pant or a portion of the training pant. The illustrated folding roll 170 is adapted to receive and hold a leading portion of one training pant per revolution. However, in various embodiments, the folding device 168 or the folding roll 170 may be adapted to receive and hold a plurality of training pants or portions thereof per revolution.

The oscillating device 148 is adapted to move in both directions as indicated by the double arrow 151. In the illustrated embodiment, the oscillating device 148 is illustrated as an oscillating roll 150 adapted to rotate in both directions as indicated by the double arrow 151. In other words, the oscillating roll 150 is alternately moved in both the clockwise direction and the counterclockwise direction. The oscillating roll 150 may be driven at any suitable surface speed. In some embodiments, the oscillating roll 150 is decelerated from a peak surface speed to a stop and is accelerated from the stop to a peak surface speed. In some embodiments, the peak surface speed is the same surface speed as the receiving roll 110 and/or the folding roll 170. The oscillating roll 150 has an outer surface 152 which includes an open area 154 and a closed area 156. The oscillating roll 150 may also include an engagement member 158 adapted to receive, hold, and transfer a portion of the training pant through the folding apparatus 100. The engagement member 158 may include some or all of the open area 154 on the surface of the oscillating roll 150. The open area 154 allows communication of vacuum forces from a vacuum source (not illustrated) to an internal vacuum sector 160 and, ultimately, to the outer surface 152 of the oscillating roll 150 when the open area 154 is aligned with the internal vacuum sector 160. The oscillating roll 150 also includes a non-vacuum sector 161 wherein no vacuum forces are communicated to the outer surface of the roll regardless of the position of the open area 154. The vacuum source may provide continuous vacuum force to the internal vacuum sector 160. The internal vacuum sector 160 and the internal non-vacuum sector 161 are fixed within the oscillating roll 150. In FIG. 2, the fixed internal vacuum sector 160 is illustrated as extending, in the counterclockwise direction, from approximately the 7:00 position to approximately the 2:00 position as described relative to the side view of the oscillating roll 150. Likewise, the fixed internal non-vacuum sector 161 is illustrated as extending, in the counterclockwise direction, from approximately the 2:00 position to approximately the 7:00 position as described relative to the side view of oscillating roll 150. Therefore, vacuum force is available for communication to the outer surface 152 through the open area 154 of oscillating roll 150 when the open area 154 is moved, in the counterclockwise direction, from the 7:00 position to the 2:00 position. Likewise, the vacuum force is available for communication to the outer surface 152 through the open area 154 of the oscillating roll 150 when the open area 154 is moved, in the clockwise direction, from the 2:00 position to the 7:00 position. In contrast, the vacuum force is not available for communication to the outer surface 152 through the open area 154 of the oscillating roll 150 when the open area 154 is moved, in the counterclockwise direction, from the 2:00 position to the 7:00 position. Said another way, the fixed internal vacuum sector 160 is illustrated as extending, in the counterclockwise direction, from a position proximate the third nip 214 to a position 219 approximately opposite the third nip 214 as described relative to the side view of the oscillating roll 150. Likewise, the fixed internal non-vacuum sector 161 is illustrated as extending, in the counterclockwise direction, from the position 219 approximately opposite the third nip 214 to a position proximate the third nip 214 as described relative to the side view of the oscillating roll 150. The delineation between the internal vacuum sector 160 and the internal non-vacuum sector 161 is illustrated with a dashed line.

In various embodiments, the engagement member 158 can be flush with the remainder of the outer surface 152 or may be raised relative to the remainder of the outer surface 152 as illustrated in FIG. 2. The open area 154 may include a plurality of openings having any suitable arrangement, quantity, shape, size, or profile. In some embodiments, the openings may be circular apertures which may be arranged to generally match the profile of the training pant or a portion of the training pant. In some embodiments, the openings may be arranged to match the profile of the leading portion of the training pant.

The transferring device 188 is adapted to move in the direction indicated by arrow 191. In the illustrated embodiment, the transferring device 188 is shown as a transferring roll 190 adapted to rotate in the direction 191. As illustrated, the transferring roll 190 is rotated in a clockwise direction. The transferring roll 190 may be driven at any suitable speed. In some embodiments, the transferring roll 190 is driven at a constant surface speed, and suitably at the same surface speed as the receiving roll 110 and/or the second conveyor 105 (FIG. 1). The transferring roll 190 has an outer surface 192 which includes an open area 194 and a closed area 196. The transferring roll 190 may also include an engagement member 198 adapted to receive, hold, and feed the training pant through the folding apparatus 100. The engagement member 198 may include some or all of the open area 194 on the surface of the transferring roll 190. The open area 194 allows communication of vacuum forces from a vacuum source (not illustrated) to an internal vacuum sector 200 and, ultimately, to the outer surface 192 of the transferring roll 190 when the open area 194 is aligned with the internal vacuum sector 200. The transferring roll 190 also includes a non-vacuum sector 201 wherein no vacuum forces are communicated to the outer surface of the roll regardless of the position of the open area 194. The vacuum source may provide continuous vacuum force to the internal vacuum sector 200. The internal vacuum sector 200 and the internal non-vacuum sector 201 are fixed within the transferring roll 190. In FIG. 2, the fixed internal vacuum sector 200 is illustrated as extending, in the direction of rotation 191, from approximately the 5:00 position to approximately the 12:00 position as described relative to the side view of transferring roll 190. Likewise, the fixed internal non-vacuum sector 201 is illustrated as extending, in the direction of rotation 191, from approximately the 12:00 position to approximately the 5:00 position. Therefore, vacuum force is available for communication to the outer surface 192 through the open area 194 of transferring roll 190 when the open area 194 is moved, in the direction of rotation 191, from the 5:00 position to the 12:00 position. Likewise, vacuum force is not available for communication to the outer surface 192 through the open area 194 of the transferring roll 190 when the open area 194 is moved, in the direction of rotation 191, from the 12:00 position to the 5:00 position. Said another way, the fixed internal vacuum sector 200 is illustrated as extending, in the direction of rotation 191, from a position proximate the fourth nip 216 to a position proximate the transfer nip 218 (FIG. 1). Likewise, the fixed internal non-vacuum sector 201 is illustrated as extending, in the direction of rotation 191, from a position proximate the transfer nip 218 (FIG. 1) to a position proximate the fourth nip 216. The delineation between the internal vacuum sector 200 and the internal non-vacuum sector 201 is illustrated with a dashed line.

In various embodiments, the engagement member 198 can be flush with the remainder of the outer surface 192 or may be raised relative to the remainder of the outer surface 192 as illustrated in FIG. 2. The open area 194 may include a plurality of openings having any suitable arrangement, quantity, shape, size, or profile. In some embodiments, the openings may be circular apertures which may be arranged to generally match the profile of the training pant in the folded configuration. The illustrated transferring roll 190 is adapted to receive and hold one folded training pant per revolution. However, in various embodiments, the transferring device 188 or the transferring roll 190 may be adapted to receive and hold a plurality of folded training pants per revolution.

Each of the receiving device 108, the oscillating device 148, the folding device 168, and the transferring device 188 are described herein as using vacuum force to hold the training pant 400 to select portions of their respective outer surface. It is contemplated, however, that other suitable mechanisms (e.g., adhesive, frictional members, nano-fabricated hairs, mechanical clamps, and the like) capable of grasping, controlling, and releasing the training pant 400 can be used instead of or in conjunction with vacuum force.

Continuing to refer to FIG. 2, the folding apparatus 100 also includes a product path 220 having a first part 222 and a second part 224. The product path 220 also defines a product movement direction 221. The first part 222 defines a path traveled by the leading portion of the article through the apparatus 100. The second part 224 defines a path traveled by the trailing portion of the article through the apparatus 100.

The first part 222 of the product path 220 includes, first, the surface of the receiving roll 110 defined by a first portion 122 of the internal vacuum sector 118. The first portion 122 of the internal vacuum sector 118 generally extends, in a counterclockwise direction, from a position proximate the receiving nip 217 (FIG. 1) to a position proximate the first nip 210. The first part 222 of the product path 220 includes, second, the first nip 210. The first part 222 of the product path 220 includes, third, the surface of the folding roll 170 defined by the internal vacuum sector 180. Fourth, the first part 222 of the product path 220 includes the second nip 212. Fifth, the first part 222 of the product path 220 includes the surface of the oscillating roll 150 defined by a first portion 202 of the internal vacuum sector 200. The first portion 202 of the internal vacuum sector 200 generally extends, in a counterclockwise direction, from a position proximate the second nip 212 to a position 219 on the oscillating roll 150 opposite the third nip 214 and extends, in a clockwise direction, from the position 219 to the second nip 212. In other words, the first part 222 of the product path 220 reverses back onto itself in this section. The first part 222 of the product path 220 includes, sixth, the surface of the oscillating roll 150 defined by a second portion 204 of the internal vacuum sector 200. The second portion 204 of the internal vacuum sector 200 generally extends, in a clockwise direction, from a position proximate the second nip 212 to a position proximate the third nip 214. The first part 222 of the product path 220 includes, seventh, the third nip 214. The first part 222 of the product path 220 includes, eighth, the surface of the receiving roll 110 defined by a second portion 124 of the internal vacuum sector 118. The second portion 124 of the internal vacuum sector 118 generally extends, in a counterclockwise direction, from a position proximate the third nip 214 to a position proximate the fourth nip 216. In some embodiments, the first part 222 also includes, ninth, the fourth nip 216. In some embodiments, the first part 222 of the product path 220 also includes, tenth, the surface of the transfer roll 190 defined by the internal vacuum sector 200. Thus, in some embodiments, the first part 222 of the product path 220 does not include a third portion 125 of the outer surface 112 of the receiving roll 110. The third portion 125 extends, in a counterclockwise direction, from a position proximate the first nip 210 to a position proximate the third nip 214.

The second part 224 of the product path 220 includes, first, the first portion 122 of the internal vacuum sector 118 of the receiving roll 110. The second part 224 includes, second, the first nip 210. The second part 224 of the product path 220 includes, third, the third portion 125 of the internal vacuum sector 118. The second part 224 of the product path 220 includes, fourth, the third nip 214. The second part 224 of the product path 220 includes, fifth, the second portion 124 of the internal vacuum sector 118 of the receiving roll 110. In some embodiments, the second part 224 of the product path 220 includes, sixth, the fourth nip 216. In some embodiments, the second part 224 includes, seventh, the surface of the transfer roll 190 defined by the internal vacuum sector 200.

Figure 3:
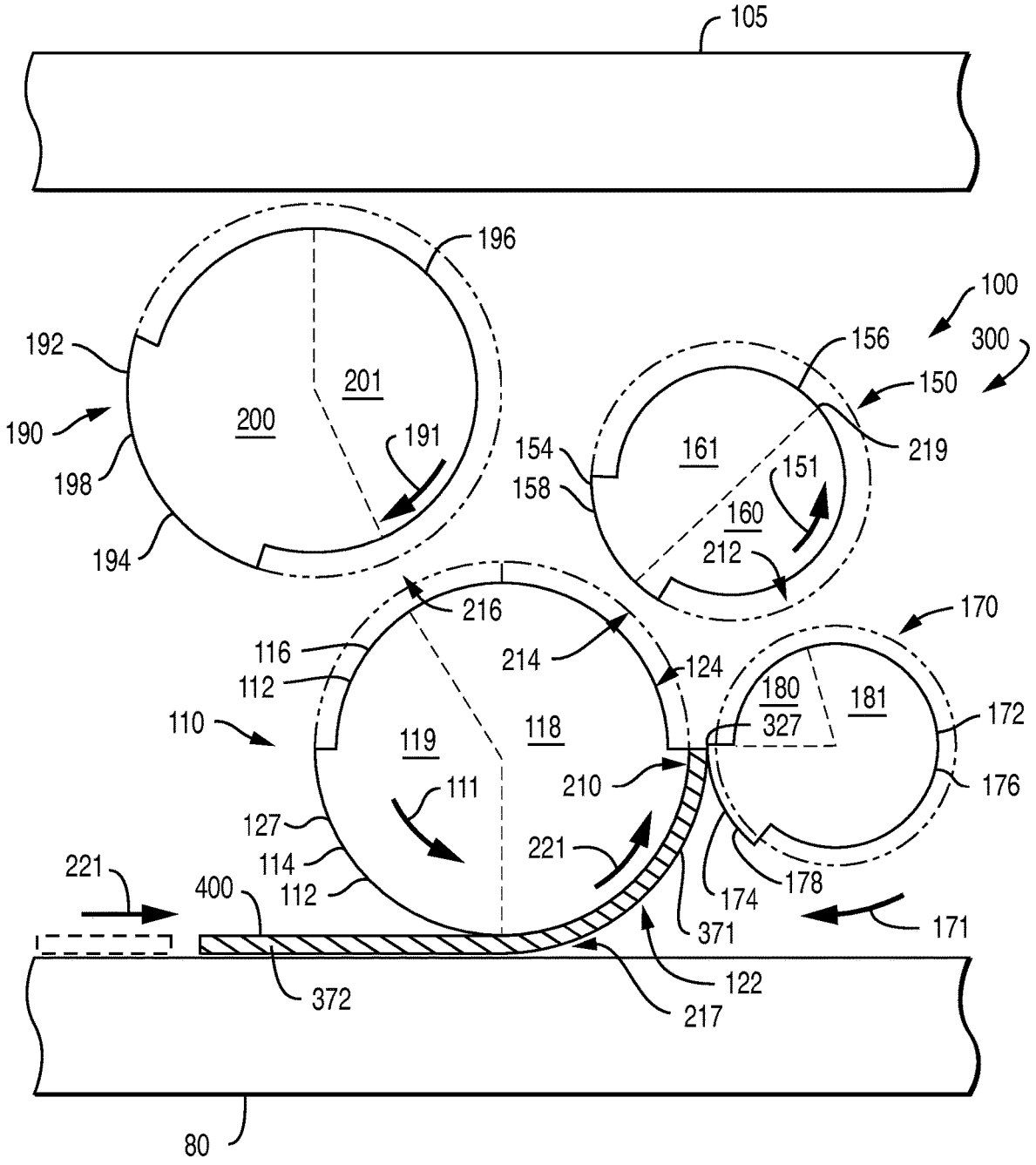
FIGS. 3-9 are schematic views of the folding apparatus of FIG. 2 illustrating an exemplary product at various stages of folding using an exemplary method.
Figure 4:
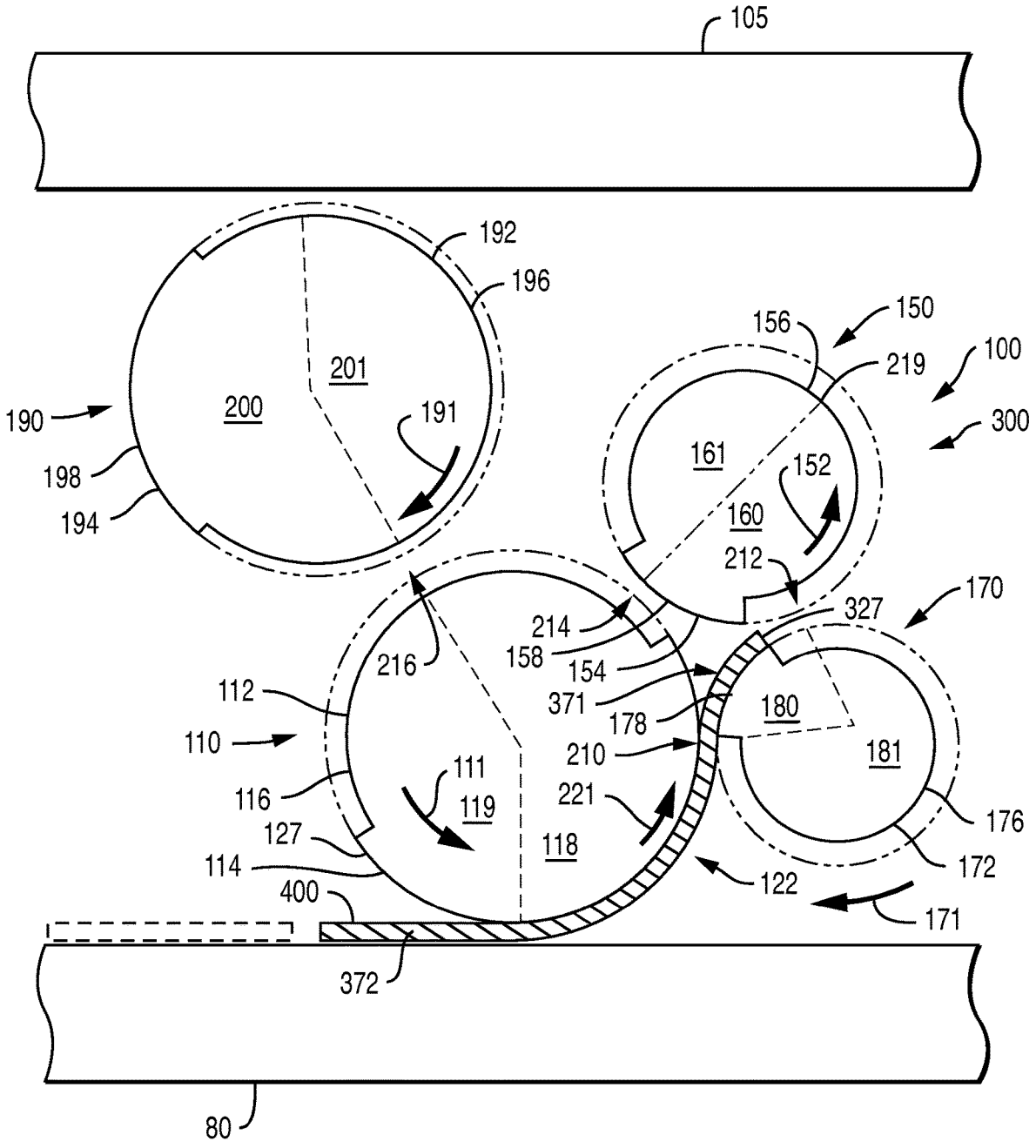
Figure 5:
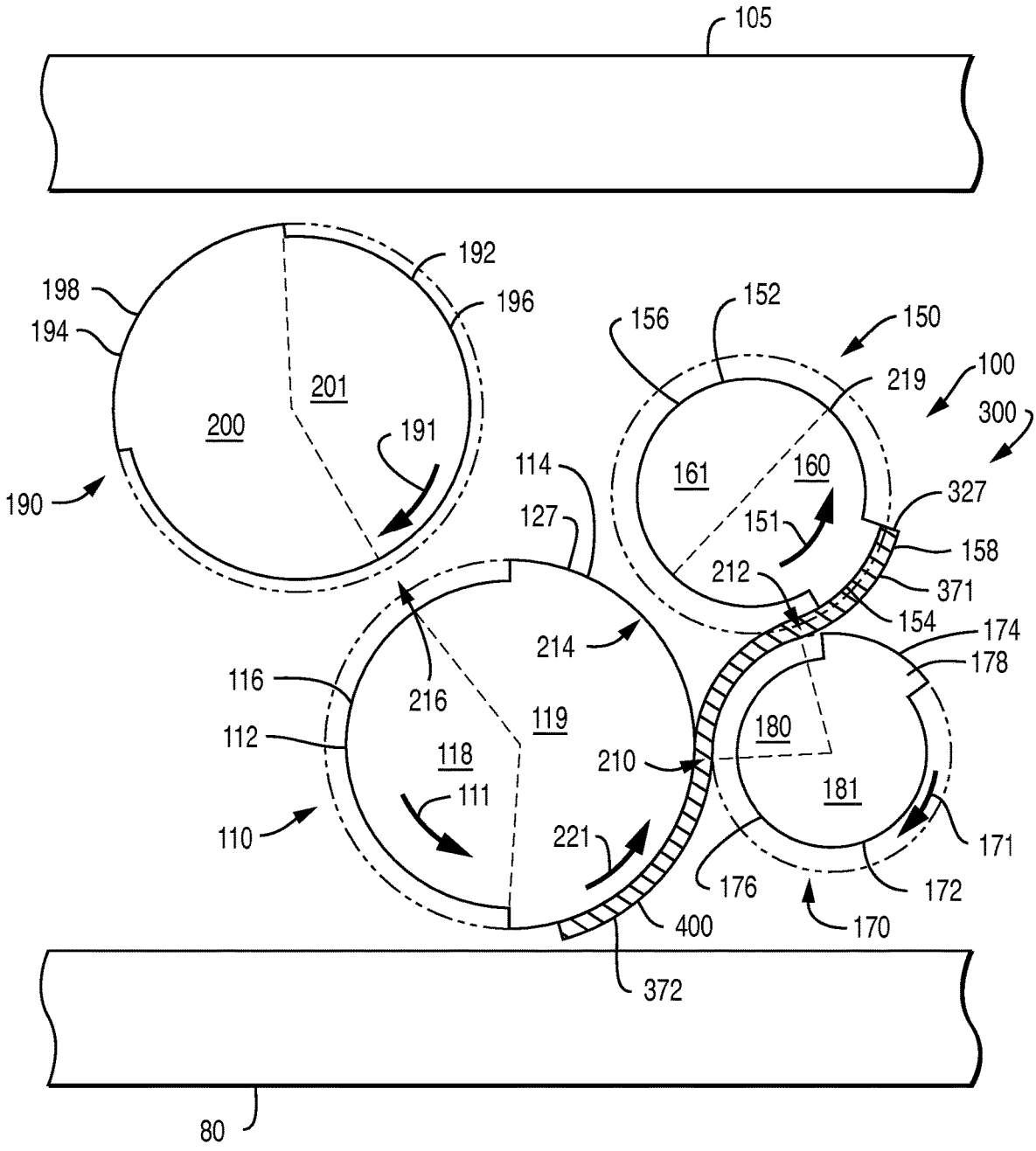

Referring now to FIGS. 3-9, the folding apparatus 100 of FIG. 2 is illustrated in various stages of folding an exemplary training pant 400 using an exemplary method 300. The exemplary training pant 400 defines a leading edge 327, a leading portion 371, and a trailing portion 372. The leading portion 371 is proximate the leading edge 327 and the trailing portion 372 is distal the leading edge 327. As used herein, the terms "leading" and "trailing" describe the portions of the article relative to the direction of movement as the article enters the folding apparatus 100. When the leading edge 327 of the training pant 400 reaches the receiving roll 110 at receiving nip 217 the training pant 400 is aligned with and is incrementally grasped by the engagement member 127 of the receiving roll 110 in the first portion 122 of the internal vacuum sector 118 as illustrated in FIG. 3. As the receiving roll 110 rotates away from the first conveying member 80, the leading edge 327 and the leading portion 371 of the training pant 400 are incrementally lifted from the first conveying member 80 and transferred to the receiving roll 110 via vacuum force. The vacuum force is communicated from a vacuum source (not illustrated) via the internal vacuum sector 118 and through portions of the open area 114 in the engagement member 127 when it is aligned with the internal vacuum sector 118 as illustrated in FIG. 3. As the trailing portion 372 of the training pant 400 is delivered to the receiving roll 110 by the first conveying member 80 at the receiving nip 217, it is aligned with and grasped by the receiving roll in substantially the same manner as the leading portion 371 as illustrated in FIGS. 4 and 5. In some embodiments, pressurized air may be used to assist in the transfer of the first portion from the conveying member 80 to the receiving roll 110 at a position proximate the receiving nip 217 (Not illustrated).

As the training pant 400 rotates with the receiving roll 110, the leading edge 327 of the training pant is moved to a position adjacent the folding roll 170 at the first nip 210 as seen in FIG. 3. As the leading edge 327 of the training pant 400 approaches the first nip 210, the engagement member 178 of the folding roll 170 moves adjacent the receiving roll 110. In some embodiments, the vacuum within the receiving roll 110 may be blocked or reduced proximate the first nip 210 to promote the release of the leading edge 327 (not shown). The folding roll 170 is configured such that, as the leading edge 327 of the training pant 400 approaches the engagement member 178 of the folding roll 170, the training pant 400 is subject to vacuum and is grasped by the engagement member 178 proximate the first nip 210. The vacuum may be ported into the interior of the folding roll 170 and communicated to portions of the outer surface 172 via the internal vacuum sector 180. The vacuum may also be blocked from the surface at other internal non-vacuum sectors 181. In some embodiments, pressurized air may be used to assist in the transfer of the first portion 371 from the receiving roll 110 to the engagement member 178 of the folding roll 170.

The first portion 371 of the training pant 400 is transferred to the engagement member 178 of the folding roll 170 while the folding roll 170 is moving in the direction 171, which is opposite the direction of rotation 111 of the receiving roll 110. In some embodiments, the folding roll 170 may be rotating at approximately the same surface speed as the receiving roll 110 when the first portion 371 of the training pant 400 is transferred from the receiving roll 110 to the folding roll member 170.

The second portion 372 of the training pant 400 remains held to the receiving roll 110 as the vacuum continues to be applied via the internal vacuum sector 118 to the surface of the receiving roll 110 as illustrated in FIGS. 4 and 5. The leading edge 327 and the leading portion 371 of the training pant 400 are held on the folding roll 170 as illustrated in FIG. 4.

With the folding roll 170 continuing to rotate in the direction 171, the first portion 371 of the training pant 400 is contacted by the engagement member 158 of the oscillating roll 150 at the second nip 212. At this stage of the process, the outer cylinder of the folding roll 170 is rotating at generally the same surface speed as the outer cylinder of the oscillating roll 150 but in opposite directions. The rotational surface speed of the outer cylinders of the oscillating roll 150 and the folding roll 170 at this point in the folding process are about the same as the rotational surface speed of the receiving roll 110. As a result, the trailing portion 372 of the training pant 400 is moving at about the same speed as the leading portion 371.

As the leading portion 371 of the training pant 400 rotates with the folding roll 170, the leading edge 327 of the training pant is moved adjacent the oscillating roll 150. The vacuum within the folding roll 170 may be blocked or reduced proximate the second nip 212 to promote the release of the leading portion 371 of the training pant 400 as it rotates beyond the second nip 212 as illustrated in FIG. 5.

Because the vacuum being applied by the folding roll 170 is now blocked proximate the second nip 212, the leading portion 371 of the training pant transfers from the engagement member 178 of the folding roll 170 to the engagement member 158 of the oscillating roll 150. The oscillating roll 150 is configured to apply vacuum to the leading portion 371 of the training pant 400. As a result, the leading portion 371 of the training pant 400 transfers to the engagement member 158 of the oscillating roll 150 at the second nip 212 as illustrated in FIG. 5.

Figure 6:
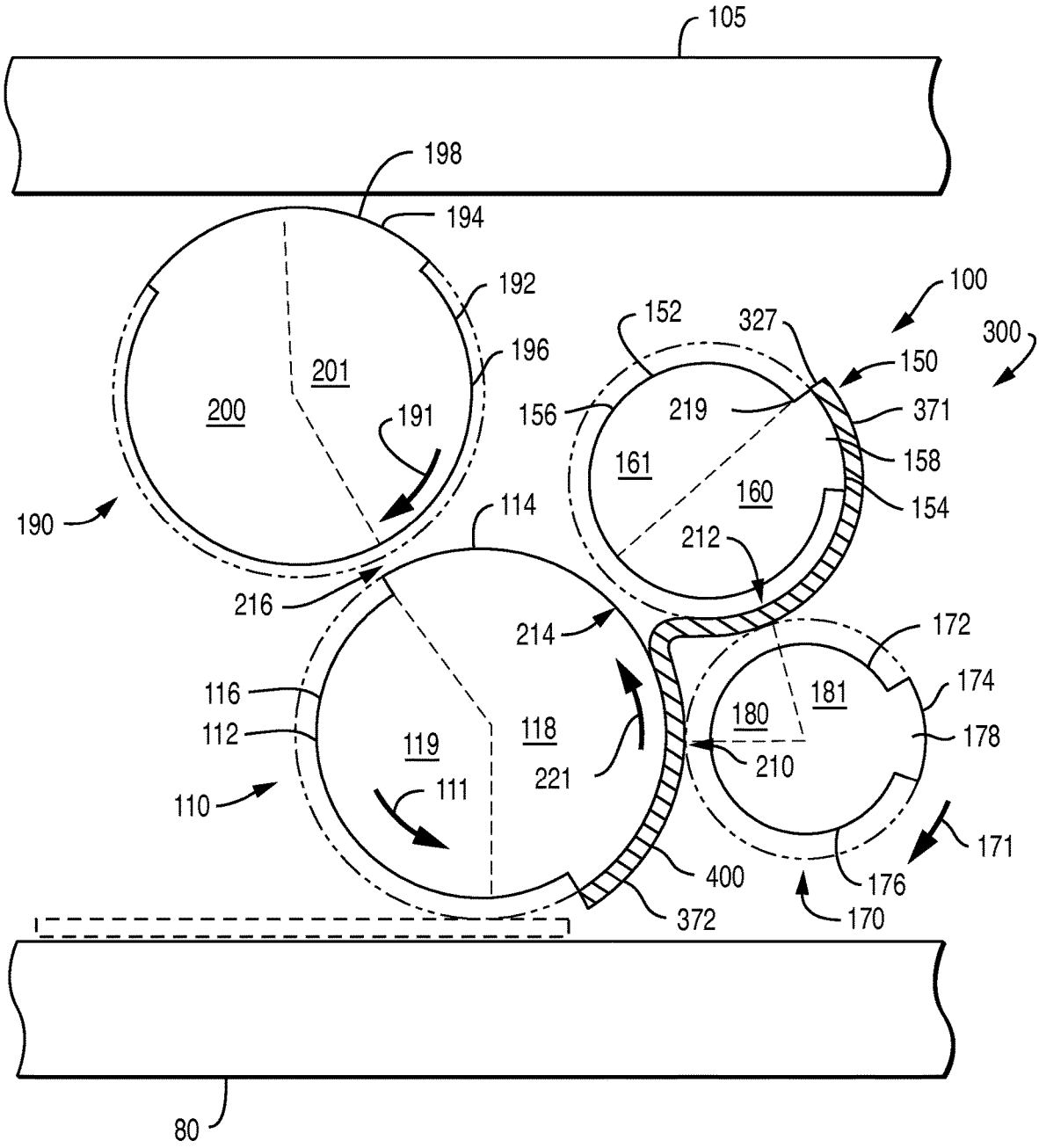

Referring now to FIG. 6, the oscillating roll 150 is illustrated in the transition from counterclockwise rotation to clockwise rotation. This transition involves slowing, stopping, and accelerating the outer surface of the oscillating roll 150 in the reverse direction. Because of the slowing, stopping, and changing rotational direction relative to the outer cylinder speed of the receiving roll 110, the training pant 400 begins to fold as illustrated in FIG. 6. The leading portion 371 of the training pant 400 remains securely held to the oscillating roll 150 and the trailing portion 372 of the training pant 400 remains securely held to the receiving roll 110 but because of the speed differential between the leading portion 371 and the trailing portion 372, a gradual (i.e., incremental) fold is initiated.

Figure 7:
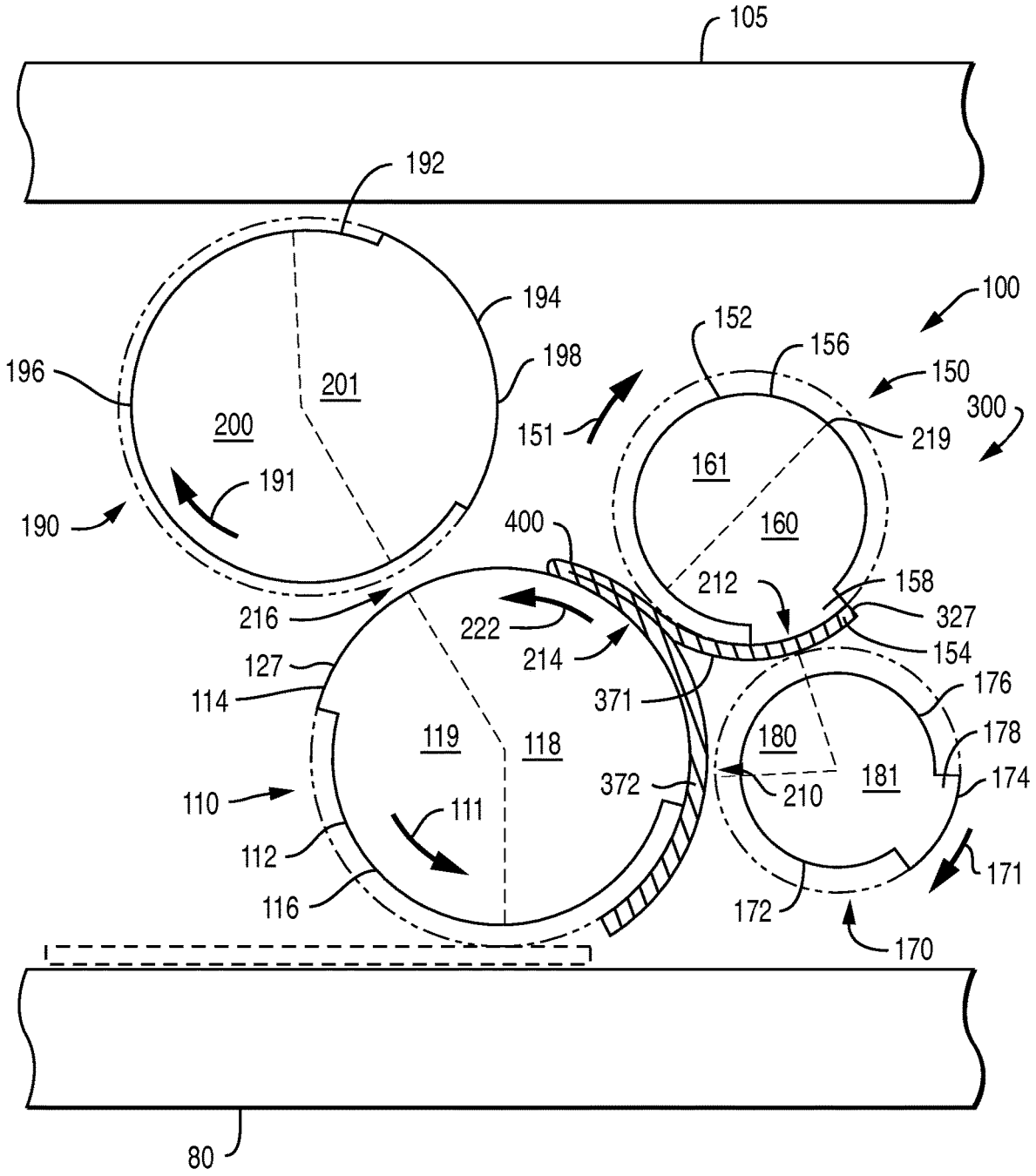

As the engagement member 158 of the oscillating roll 150 is moved in a direction opposite (clockwise) the receiving roll 110, the training pant 400 continues to be folded incrementally in the third nip 214 between the oscillating roll 150 and the receiving roll 110. The vacuum being applied by the oscillating roll 150 is no longer communicated through the engagement member 158 proximate the third nip 214. The leading portion 371 of the training pant transfers from the engagement member 158 of the oscillating roll 150 to overlay the trailing portion 372 of the training pant that remains held to the surface of the receiving roll 110 as illustrated in FIG. 7.

Figure 8:
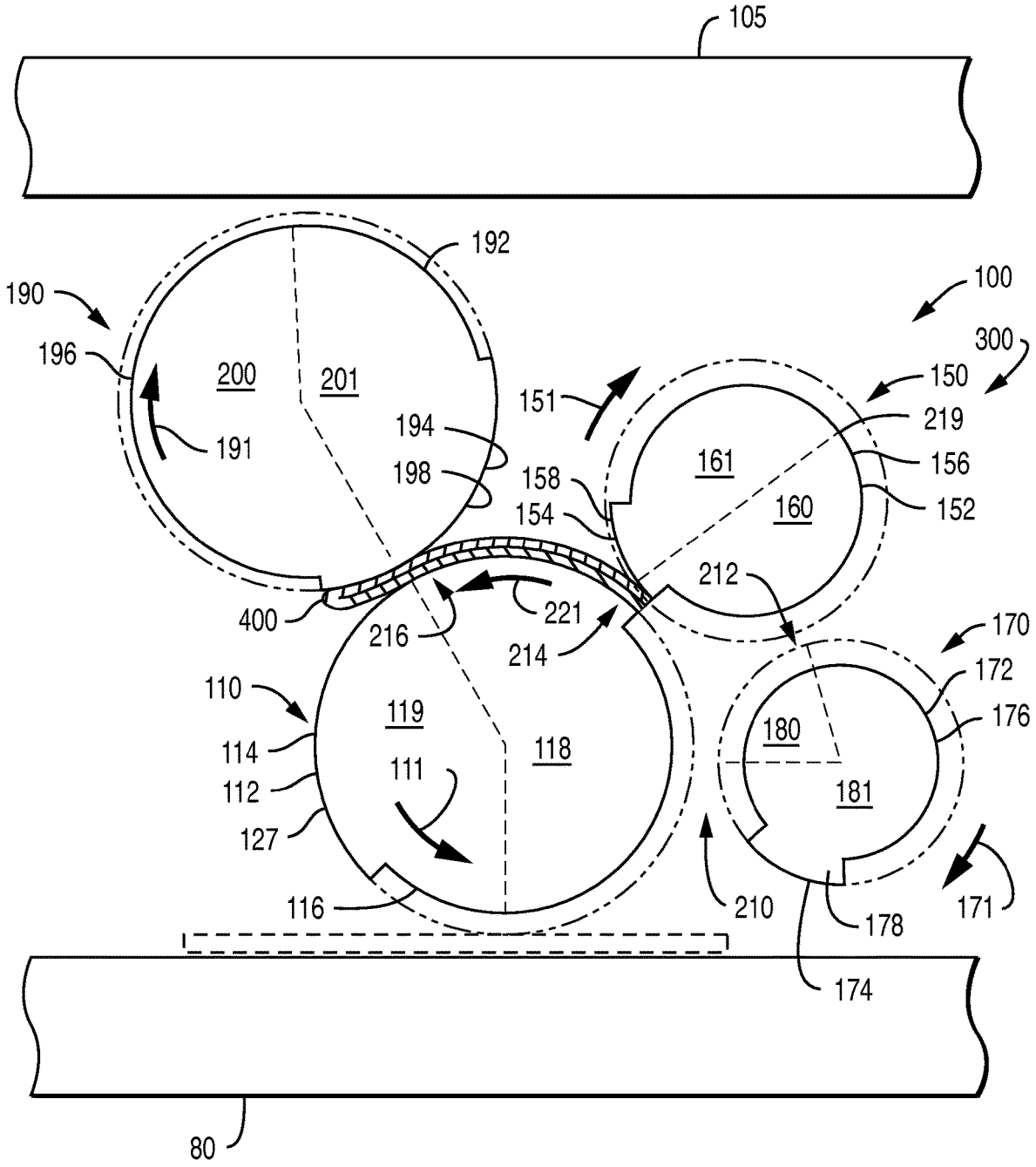

The oscillating roll 150 continues moving in the clockwise direction until the leading portion 371 of the training pant 400 is completely transferred from the oscillating roll 150 to the receiving roll 110 and the leading portion 371 of the training pant 400 is overlying the trailing portion 372 as illustrated in FIG. 8.

The oscillating roll 150 is adapted such that the internal vacuum is not communicated through the engagement member 158 as it transitions into alignment with the internal non-vacuum sector 161 proximate the third nip 214. As a result, the vacuum holding the leading portion 371 of the training pant 400 to the engagement member 158 of the oscillating roll 150 is blocked to allow the first portion 371 of the training pant 400 to fully transfer back to the receiving roll 110 and the training pant 400 is arranged in its folded configuration as illustrated in FIG. 8.

In various embodiments, the training pant 400, which is in its folded configuration, may then be transferred from the receiving roll 110 to the transferring roll 190 at the fourth nip 216 between the receiving roll and the transferring roll. The outer cylinder of the receiving roll 110 continues to rotate in the counterclockwise direction at a constant surface speed. The outer cylinder of the transferring roll 190 rotates clockwise at approximately the same surface speed as the outer cylinder of the receiving roll 110.

Figure 9:
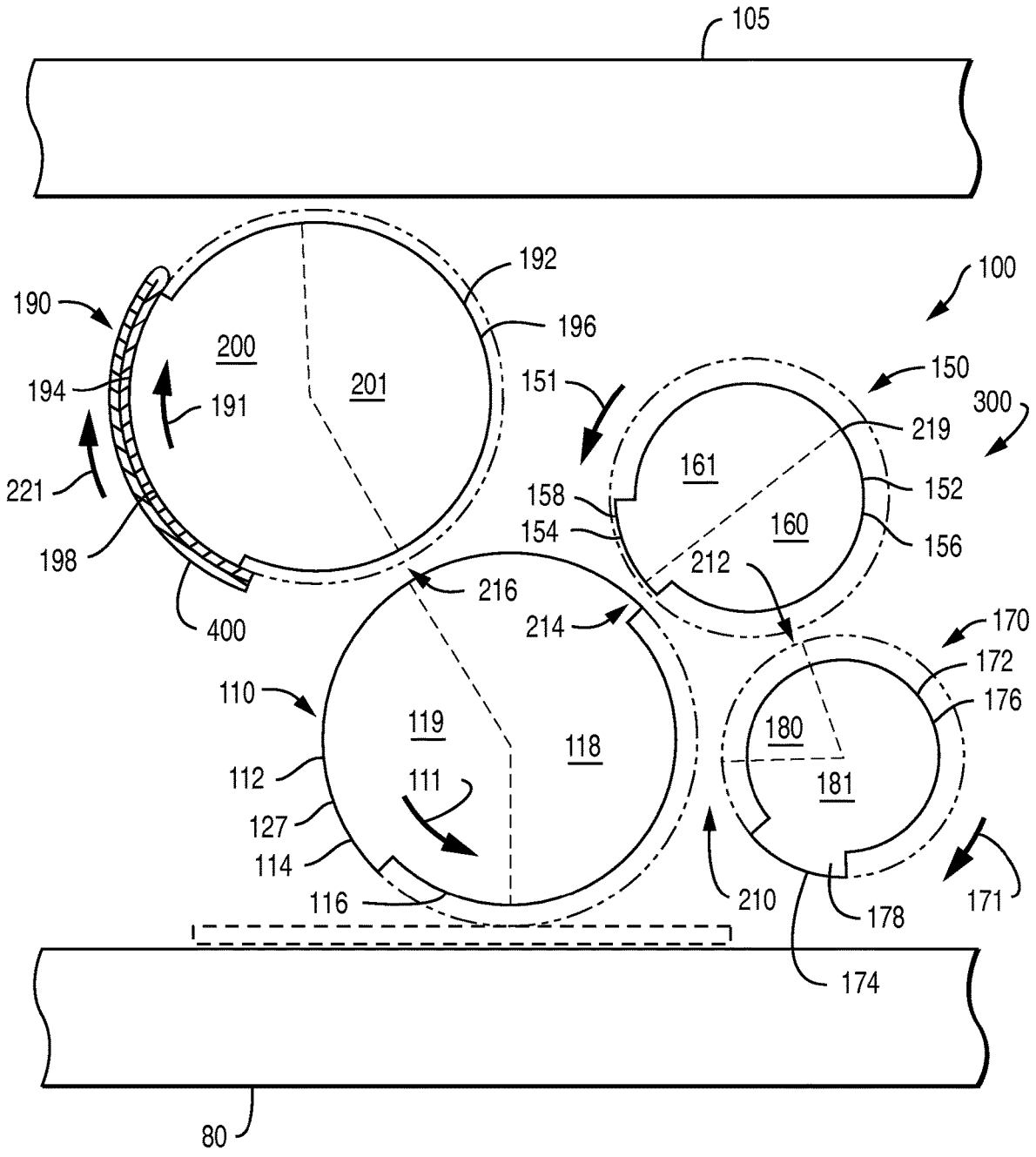

The receiving roll 110 is adapted to block communication of the vacuum to the engagement member 127 proximate the fourth nip 216 as the engagement member 127 transitions into alignment with the internal non-vacuum sector 119. As a result, the training pant 400 is free from the vacuum of the receiving roll 110 at this location. The transferring roll 190 is adapted such that vacuum is applied starting proximate the fourth nip 216 as the engagement member 198 transitions into alignment with the internal vacuum sector 200. Thus, the outer cylinder of the transferring roll 190 grasps the folded training pant 400 and the training pant 400 is transferred from the receiving roll 110 to the transferring roll 190 as illustrated in FIG. 9.

In various embodiments, the folded pant may be transported to any suitable apparatus for further processing or packaging. In some embodiments, and as illustrated in FIG. 1, the transferring roll 190 may transfer the training pant 400 to the second conveying member 105, which carries the training pant 400 to additional components of the manufacturing system 50. In the illustrated embodiment, the second conveying member 105 is a vacuum belt conveyor. Other devices suitable for use as the second conveying member 105 are well-known in the art and include, but are not limited to, drums, rollers, air conveyors, vacuum conveyors, chutes, and the like.

Figure 10:
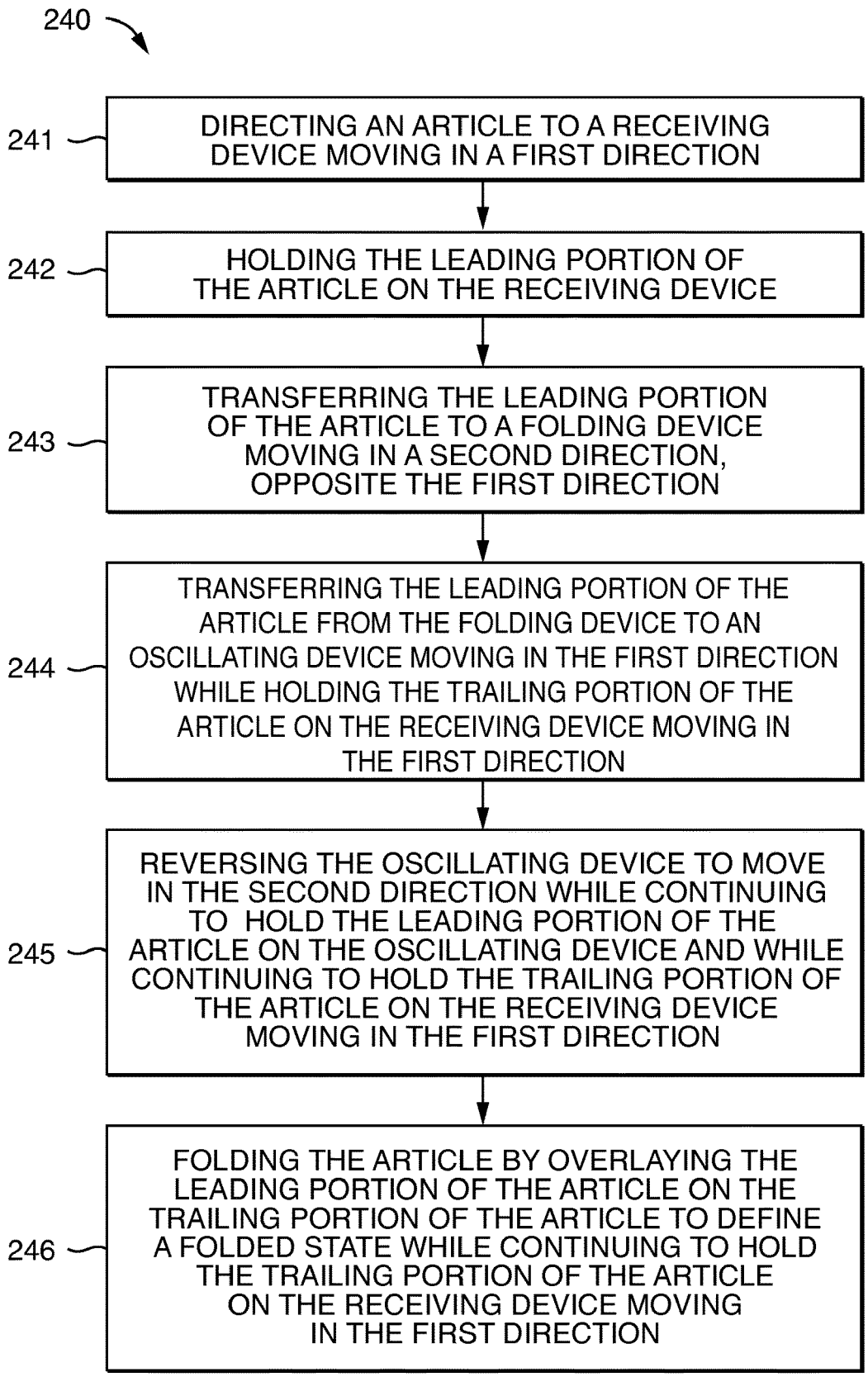
FIG. 10 is a block diagram of an exemplary method of the present invention.

Referring now to FIG. 10, another method 240 for folding an article is illustrated as a block diagram. The method 240 includes a first step 241 of directing an article to a receiving device moving in a first direction. The article of this method includes a leading portion and a trailing portion. The second step 242 of the method 240 includes holding the leading portion of the article on the receiving device. The third step 243 is transferring the leading portion of the article to a folding device moving in a second direction. The second direction is opposite the first direction. The fourth step 244 is transferring the leading portion of the article from the folding device to an oscillating device moving in the first direction while holding the trailing portion of the article on the receiving device moving in the first direction. The method also includes a fifth step 245 of reversing the oscillating device to move in the second direction while continuing to hold the leading portion of the article on the oscillating device and while continuing to hold the trailing portion of the article on the receiving device moving in the first direction. The sixth step 246 of the method 240 is folding the article by overlaying the leading portion of the article on the trailing portion of the article to define a folded state while continuing to hold the trailing portion of the article on the receiving device moving in the first direction.

In various embodiments, the method 240 may also include moving the receiving device continuously in the first direction, moving the folding device continuously in the second direction, and moving the oscillating device alternately between the first direction and the second direction.

In various embodiments, the method 240 may also include communicating a first vacuum supply to a fixed internal vacuum sector of the receiving device; communicating a second vacuum supply to a fixed internal vacuum sector of the folding device; and communicating a third vacuum supply to a fixed internal vacuum sector of the oscillating device. In some embodiments, the method 240 may also include the step of providing a continuous first vacuum supply, a continuous second vacuum supply, and continuous third vacuum supply.

In various embodiments, the method 240 may also include the step of communicating a fourth vacuum supply to a fixed internal vacuum sector of a transfer device, the step of moving the surface of the transfer device in the second direction, and the step of transferring the article in a folded state from the receiving device to the transfer device.

In some embodiments, the method 240 may also include the step of directing the leading portion of the article through the first nip defined by the receiving device and the folding device. The method 240 may include the step of directing the leading portion of the article through a second nip, defined by the folding device and the oscillating device, after the previous step. The method 240 may also include the step of directing the leading portion of the article through a third nip, defined by the oscillating device and the receiving device, after the previous step. The method 240 may also include the step of directing the leading portion of the article through a fourth nip, defined by the receiving device and the transferring device, after the previous step. The method 240 may also include the steps of directing the trailing portion of the article through the first nip, bypassing the second nip with the trailing portion of the article after the previous step, and directing the trailing portion of the article through the third nip after bypassing the second nip.

In some embodiments, the method 240 may also include the steps of first moving the leading portion of the article at a first speed and second moving the trailing portion of the article at the first speed. The method 240 may also include, third, moving the leading portion of the article at a second speed, slower than the first speed, while continuing to move the trailing portion of the article at the first speed. The method 240 may also include, fourth, stopping the leading portion of the article while continuing to move the trailing portion of the article at the first speed. The method 240 may also include, fifth, accelerating the leading portion of the article to the first speed and, sixth, moving the leading portion and the trailing portion at the first speed. In some embodiments, the third step may include moving the leading portion in a first direction and the fifth step may include moving the leading portion in a second direction that is different than the first direction.

Figure 11:
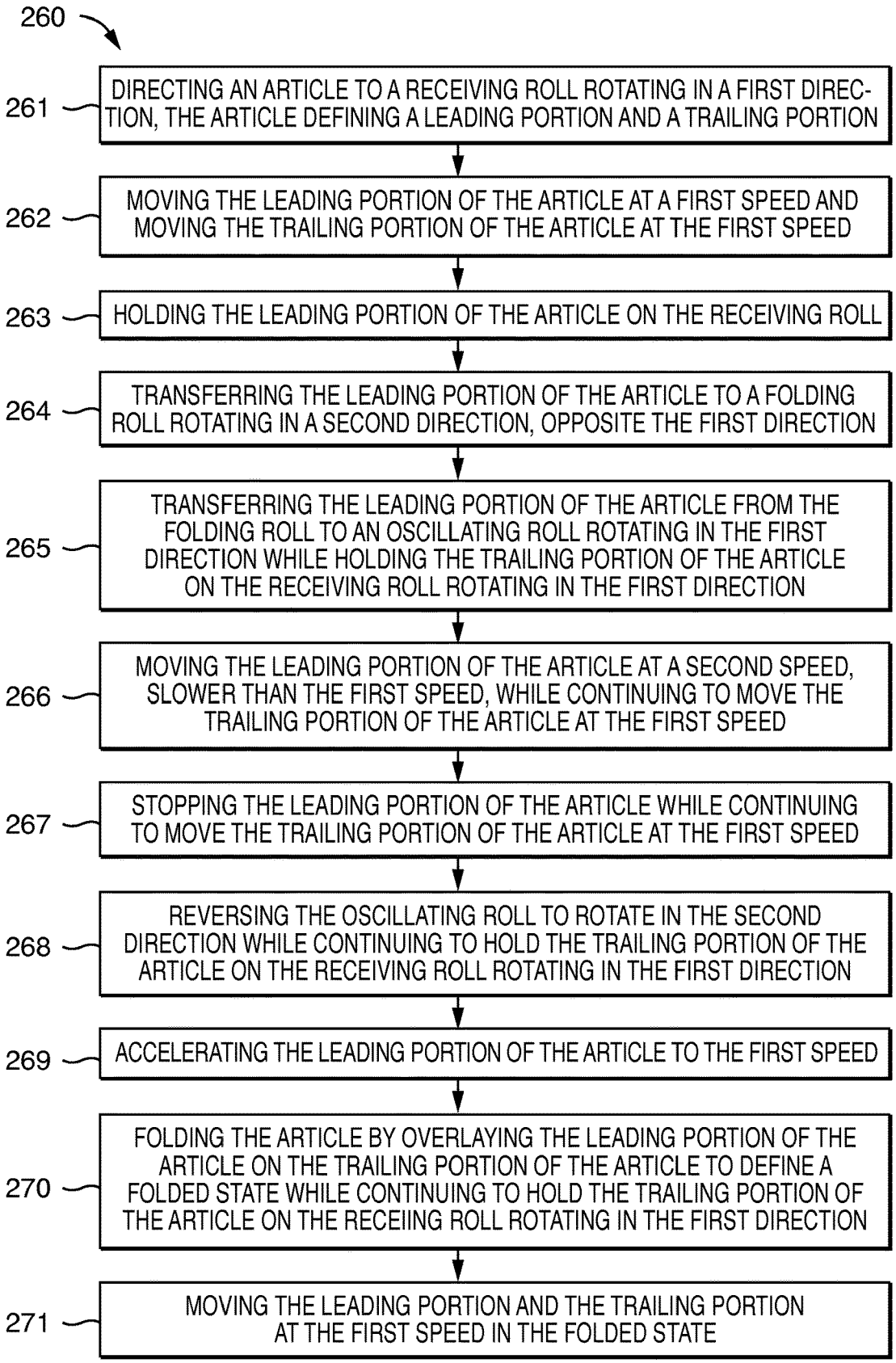
FIG. 11 is a block diagram of another exemplary method of the present invention.

Referring now to FIG. 11, another method 260 for folding an article is illustrated as a block diagram. The method 260 includes a first step 261 of directing an article to a receiving roll rotating in a first direction. The article defines a leading portion and a trailing portion. The second step 262 includes moving the leading portion of the article at a first speed and moving the trailing portion of the article at the first speed. The method 260 also includes a third step 263 of holding the leading portion of the article on the receiving roll and the fourth step 264 of transferring the leading portion of the article to a folding roll rotating in a second direction, opposite the first direction. The method 260 also includes the fifth step 265 of transferring the leading portion of the article from the folding roll to an oscillating roll rotating in the first direction while holding the trailing portion of the article on the receiving roll rotating in the first direction. The method 260 also includes the sixth step 266 of moving the leading portion of the article at a second speed, slower than the first speed, while continuing to move the trailing portion of the article at the first speed. The seventh step 267 includes stopping the leading portion of the article while continuing to move the trailing portion of the article at the first speed. The eighth step 268 includes reversing the oscillating roll to rotate in the second direction while continuing to hold the trailing portion of the article on the receiving roll rotating in the first direction. The method 260 also includes the ninth step 269 of accelerating the leading portion of the article to the first speed and the tenth step 270 of folding the article by overlaying the leading portion of the article on the trailing portion of the article to define a folded state while continuing to hold the trailing portion of the article on the receiving roll rotating in the first direction. The method 260 also includes the eleventh step 271 of moving the leading portion and the trailing portion at the first speed in the folded state. In various embodiments, the steps of method 260 may be executed in numerical order from the first step 261 to the eleventh step 271.

While the invention has been described in detail with respect to specific embodiments thereof, it will be appreciated that those skilled in the art, upon attaining understanding of the foregoing will readily appreciate alterations to, variations of, and equivalents to these embodiments. Accordingly, the scope of the present invention should be assessed as that of the appended claims and any equivalents thereto. Additionally, all combinations and/or sub-combinations of the disclosed embodiments, ranges, examples, and alternatives are also contemplated.

The invention claimed is:

1. A method for folding an article comprising the steps of, directing the article to a receiving device moving in a first direction, the article defining a leading portion and a trailing portion;

holding the leading portion of the article on the receiving device via vacuum force, a surface of the receiving device moving at a first surface speed; and then, transferring the leading portion of the article from the receiving device to a folding device, which is moving only in a second direction, opposite the first direction, the transferred leading portion being held by the folding device by vacuum force; followed by, transferring the leading portion of the article from the folding device to an oscillating device moving in the first direction while holding the trailing portion of the article on the receiving device moving in the first direction, the transferred leading portion being held by the oscillating device by vacuum force and the trailing portion being held by the receiving device by vacuum force, wherein the oscillating device alternately moves in the first direction and the second direction;

reversing the oscillating device to move in the second direction while continuing to hold the leading portion of the article on the oscillating device and while continuing to hold the trailing portion of the article on the receiving device moving in the first direction;

folding the article by overlaying the leading portion of the article on the trailing portion of the article to define a folded state while continuing to hold the trailing portion of the article on the receiving device moving in the first direction.

2. The method of claim 1 wherein the receiving device is a vacuum conveyor, the folding device is a vacuum roll, and the oscillating device is a vacuum roll, wherein the method further comprises, moving the receiving device continuously in the first direction, rotating the folding device continuously in the second direction, and rotating the oscillating device alternately between the first direction and the second direction.

3. The method of claim 1 further comprising, communicating a first vacuum supply to a fixed internal vacuum sector of the receiving device;

communicating a second vacuum supply to a fixed internal vacuum sector of the folding device; and communicating a third vacuum supply to a fixed internal vacuum sector of the oscillating device.

4. The method of claim 3 wherein, the receiving device and the folding device define a first nip;

the folding device and the oscillating device define a second nip;

the oscillating device and the receiving device define a third nip; and the internal vacuum sector of the folding device extends, in the second direction of movement, from a position proximate the first nip to a position proximate the second nip.

5. The method of claim 4 further comprising, providing the first vacuum supply, the second vacuum supply, and the third vacuum supply continuously.

6. The method of claim 4 wherein, the receiving device and a transfer device define a fourth nip and the method further comprises, communicating a fourth vacuum supply to a fixed internal vacuum sector of the transfer device, moving the transfer device in the second direction, and transferring the article in the folded state from the receiving device to the transfer device.

7. The method of claim 6 further comprising, directing the leading portion of the article through the first nip, directing the leading portion of the article through the second nip after the first nip, directing the leading portion of the article through the third nip after the second nip, directing the leading portion of the article through the fourth nip after the third nip, directing the trailing portion of the article through the first nip, bypassing the second nip with the trailing portion of the article after through the first nip, and directing the trailing portion of the article through the third nip after bypassing the second nip.

8. The method of claim 1 further comprising, first, moving the leading portion of the article at a first speed, second, moving the trailing portion of the article at the first speed, third, moving the leading portion of the article at a second speed, slower than the first speed, while continuing to move the trailing portion of the article at the first speed, fourth, stopping the leading portion of the article while continuing to move the trailing portion of the article at the first speed, fifth, accelerating the leading portion of the article to the first speed, and sixth, moving the leading portion and the trailing portion at the first speed.

9. The method of claim 8 wherein the third step includes moving the leading portion in a first direction and the fifth step includes moving the leading portion in a second direction that is different than the first direction.

10. The method of claim 1, wherein the leading portion of the article is transferred from the receiving device to the folding device without first being transferred to a separate, intervening device.

11. The method of claim 10, wherein, after the leading portion of the article is transferred from the receiving device to the folding device without first being transferred to a separate, intervening device, the leading portion of the article is transferred from the folding device to the oscillating device without first being transferred to a separate, intervening device.

12. The method of claim 11, wherein, after the leading portion of the article is transferred from the folding device to the oscillating device without first being transferred to a separate, intervening device, the leading portion of the article is then transferred from the oscillating device to the receiving device without first being transferred to a spearate, intervening device.

13. The method of claim 1, wherein, during the folding method, the folding device is rotating rotate at a constant surface speed, the constant surface speed being the same as the first surface speed.

* * * * *